US008739470B1

(12) United States Patent
Wayne et al.

(10) Patent No.: US 8,739,470 B1
(45) Date of Patent: Jun. 3, 2014

(54) ONE PIECE ROOF MATERIAL PROTECTING DRIP EDGE

(76) Inventors: Montie Wayne, Goleta, CA (US); Catherine Wayne, Goleta, CA (US)

( * ) Notice: Subject to any disclaimer, the term of this patent is extended or adjusted under 35 U.S.C. 154(b) by 0 days.

(21) Appl. No.: 13/459,814

(22) Filed: Apr. 30, 2012

Related U.S. Application Data

(60) Provisional application No. 61/518,038, filed on Apr. 29, 2011.

(51) Int. Cl.
*E04D 1/36* (2006.01)

(52) U.S. Cl.
USPC ..... 52/58; 52/96; 52/97

(58) Field of Classification Search
USPC ..... 52/58, 96, 97, 60, 302.6, 94
See application file for complete search history.

(56) References Cited

U.S. PATENT DOCUMENTS

| | | | | | |
|---|---|---|---|---|---|
| 3,242,622 | A * | 3/1966 | Snead | 52/94 |
| 3,254,460 | A * | 6/1966 | Bowser | 52/94 |
| 3,668,811 | A * | 6/1972 | Pollard | 52/94 |
| 3,738,068 | A * | 6/1973 | Attaway | 52/60 |
| 4,780,999 | A * | 11/1988 | Webb et al. | 52/96 |
| 4,848,045 | A * | 7/1989 | Nichols et al. | 52/60 |
| 5,586,414 | A * | 12/1996 | Tawzer | 52/57 |
| 6,035,587 | A * | 3/2000 | Dressler | 52/97 |
| 6,780,099 | B1 * | 8/2004 | Harper | 454/186 |
| 7,735,267 | B1 * | 6/2010 | Ayers, Jr. | 52/96 |
| 7,954,279 | B2 * | 6/2011 | Covone et al. | 52/97 |
| 8,024,894 | B1 * | 9/2011 | Ayers, Jr. | 52/96 |
| 8,281,521 | B1 * | 10/2012 | Rasmussen et al. | 52/60 |
| 2007/0074466 | A1 * | 4/2007 | Rasmussen | 52/97 |

* cited by examiner

*Primary Examiner* — Basil Katcheves
(74) *Attorney, Agent, or Firm* — Sandy Lipkin

(57) ABSTRACT

An apparatus that provides a continuous one-piece drip edge for a roof that not only protects from water damage, but also protects the roofing material at the rake and eaves from peeling as well as offer protection from wind, snow and ice and any other weather conditions that commonly strip roofing material from a roof surface.

3 Claims, 3 Drawing Sheets

ONE PIECE ROOF MATERIAL PROTECTING DRIP EDGE

REFERENCE TO PRIOR APPLICATION

This application claims the priority of provisional application 61/518,038, filed Apr. 29, 2011 entitled ONE PIECE, ROOF MATERIAL PROTECTING, DRIP EDGE by Montie Wayne and Catherine Wayne.

BACKGROUND OF THE INVENTION

1. Field of the Invention

The present invention relates generally to the field of roofing and more specifically toward an apparatus that provides a continuous one-piece protective drip edge for a roof that not only protects from water damage, but also protects the roofing material at rakes and eaves from peeling as well as offers protection from wind, snow and ice and any other weather conditions that commonly strip roofing material from a roof surface.

2. Description of the Prior Art

In the field of building construction, it is imperative that the roof provide shelter from the elements. Furthermore, the roofing material itself is subject to the elements and additions to structures are common to prevent water damage to the roofing material. Traditionally, a drip edge is added to a structure so that during rain, the water is irrigated away from the roof and made to drip along rain gutters to protect not only the roof, but the fascia of the building.

Prior art devices have not included in one single apparatus a means for protecting roofing material from peel as well as from harsh elements such as snow, wind and ice that can also be hazardous to the roofing material. Prior art devices have typically included a bottom drip edge that is nailed to the roof on top of which the roofing material is affixed. Then another piece of drip edge is nailed to the top of the shingles or other roofing material. With this method, it is common, especially in the case of pitched roofs, for the roofing materials to get blown off during high winds. It is the object of the instant invention to provide a continuous one-piece drip edge that serves not only to protect the roof from water, but to protect the roofing material at rake and eaves from peeling due the effects of weather conditions.

SUMMARY OF THE INVENTION

The preferred embodiment of the present invention teaches a continuous one-piece apparatus for the protection of roofing materials from weather elements comprising: a base that attaches to a roof, said base having a top surface, a bottom surface, a first side with a second side parallel to said first side, a third side that is proximate the edge of said roof and a fourth side that is parallel with said third side and that is distal the edge of said roof; a first panel that is attached to said third side that extends downward from said base at angle so that said first panel is substantially vertical, said panel being substantially planar and transitioning in a second panel that angles away from said panel; a third panel that is on the opposite side of said second panel that is exposed and from which water drips; an exposed fourth panel that extends upward from said third panel and that is substantially parallel with said first panel; a top panel that extends from said exposed fourth panel in a direction away from said exposed fourth panel wherein said top panel is substantially parallel with said base leaving a space between said top panel and said base for the placement therein of roof material.

The above embodiment can be further modified by defining that a lip is placed on said fourth side of said base.

The above embodiment can be further modified by defining that a lip is placed on the underside of said top panel.

The above embodiment can be further modified by defining that one or more apertures are placed on said second panel.

BRIEF DESCRIPTION OF THE DRAWINGS

This invention can better be understood by reference to the drawings, provided for exemplary purposes, and in which.

DETAILED DESCRIPTION OF A PREFERRED EMBODIMENT

Figure 1:
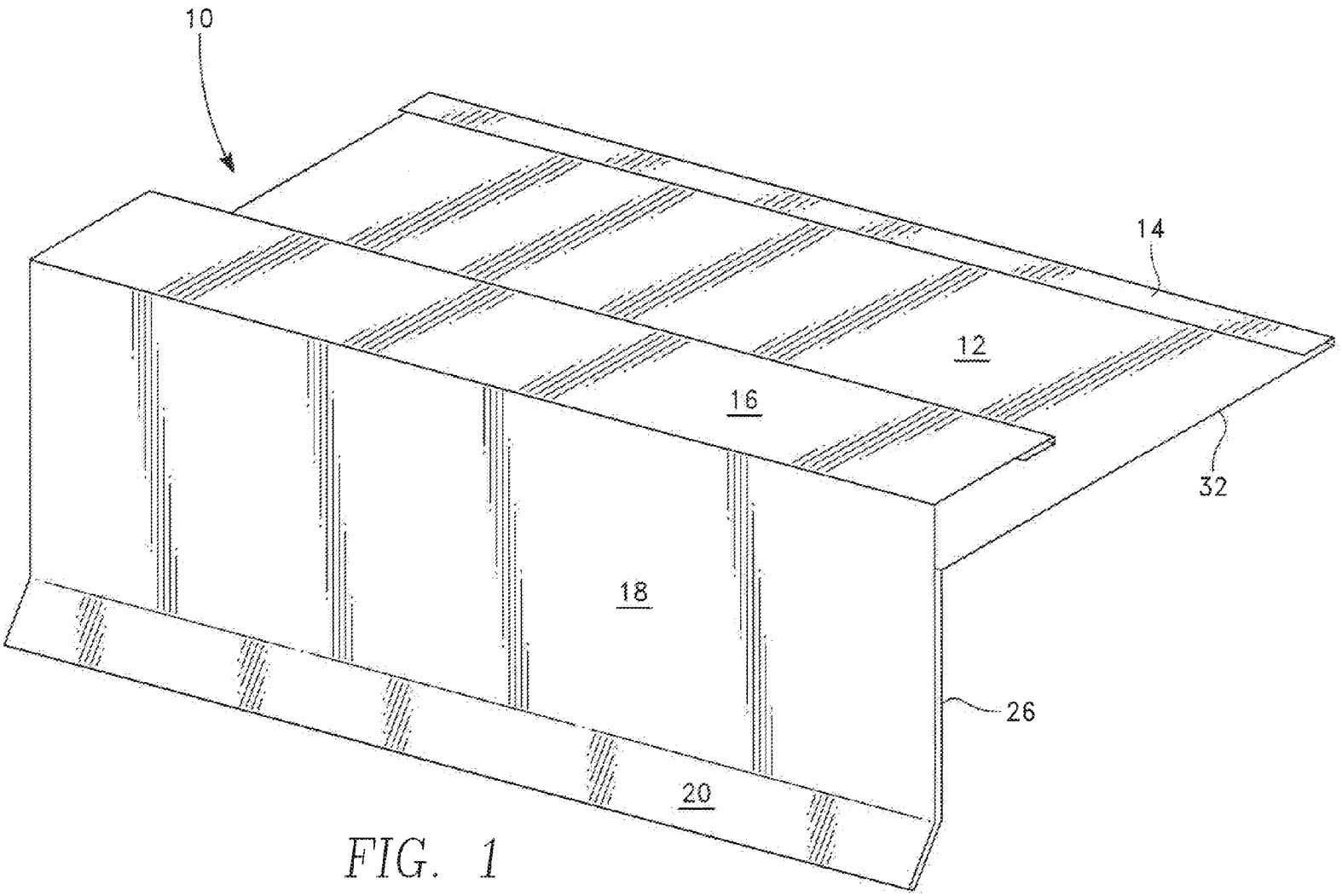
FIG. 1 is a top front perspective view of the apparatus of the instant invention.
Figure 3:
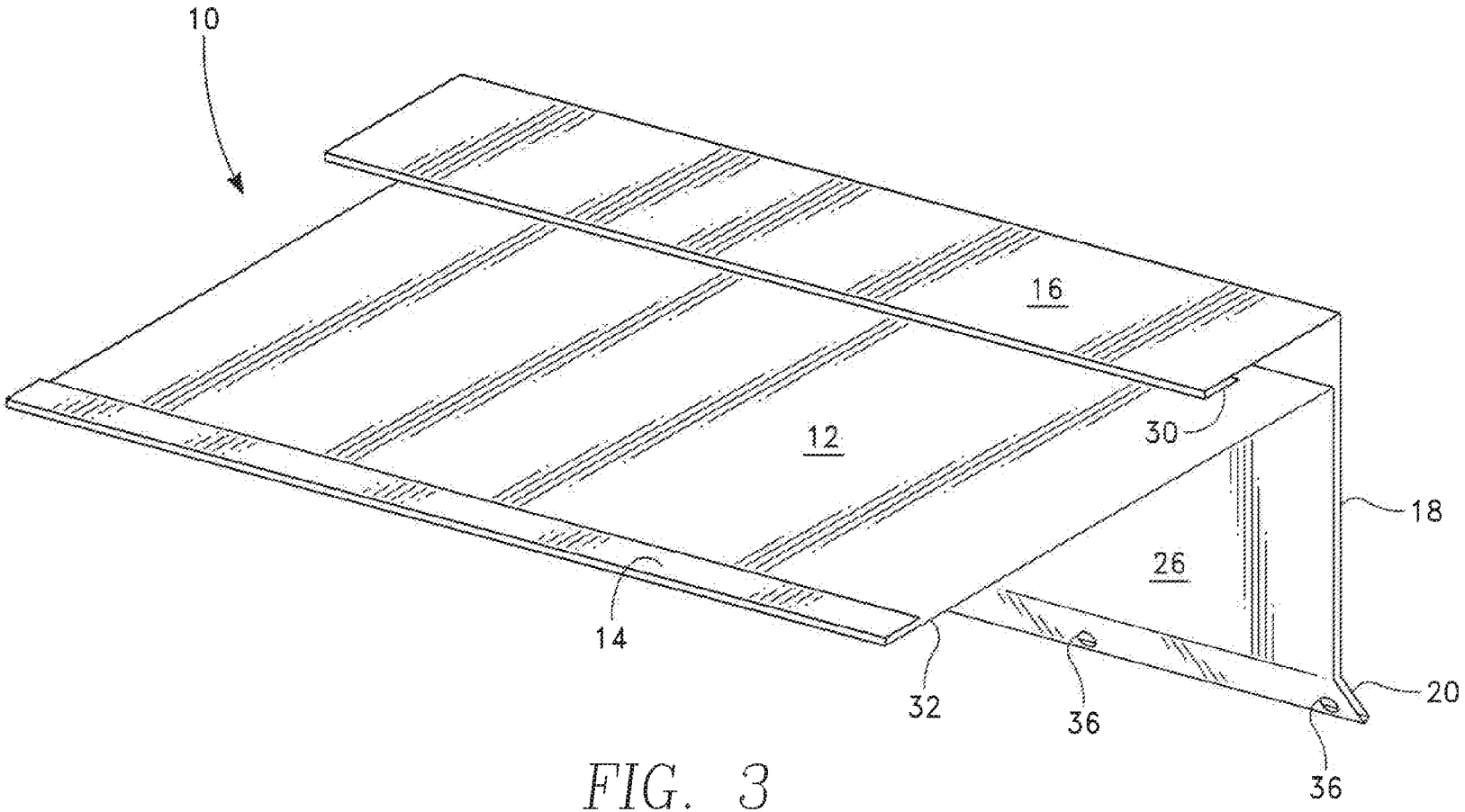
FIG. 3 is a top rear perspective view of the apparatus of the instant invention.

The instant invention provides a one piece continuous structure to be used in the construction of a building to protect the structure from water damage as well as protect the roofing material from peeling away due to the effects of weather conditions such as rain, snow wind and ice. FIGS. 1 and 3 show the device 10 both from the front rear in top perspective view.

The apparatus 10 includes a base 12 over which the roofing material is attached through nailing or other attachment means. The design allows for modification to accept different shingle sizes. It can also be modified for metal roofing by changing the upper closed hem 30 to an open hem or cleat that locks into the metal roofing panels. This upper hem is curled to provide extra strength and to protect against accidentally cutting a person or thing during use. The base 12 includes at the end furthest from the wall of the building an optional water curl 14. This water curl 14 is included to divert water straight down as needed. The base 12 includes an underside 32 that is secured to the roof before the roofing material 22 is added.

At the edge of the base 12 nearest the wall extending downward therefrom is a panel 26 that transitions in another angled panel 28 that extends outward therefrom at an angle to divert water away from the fascia 24. The angled panel 28 has an outer surface 20 from which water drips. This angled panel 28 can optionally include one or more holes 36 to allow for the dripping of accumulated water. When attached to the pitched rake, there is no risk of water retention so the holes 36 would not be needed. In the case of a pitched rake, the risk is more of wind damage than water damage. However when the device 10 is used on an eave, the holes 36 would be advised to prevent the accumulation of water between the top portion 16 and the base 12. This outer surface 20 transitions into an exposed panel 18 that is substantially parallel with the panel 26 extending downward from the base 12.

The exposed panel 18 extends upward past the roofing material 22 and provides a top surface 16 that extends away from the exposed panel 18 at an angle substantially the same as the angle between the base 12 and the panel 26 extending therefrom so as to be positioned substantially parallel with the base 12. The top surface panel 16 which is the protection for the roofing material terminates in a folded lip 30 for added strength and can be modified to clip onto metal roofing panels 22.

Figure 2:
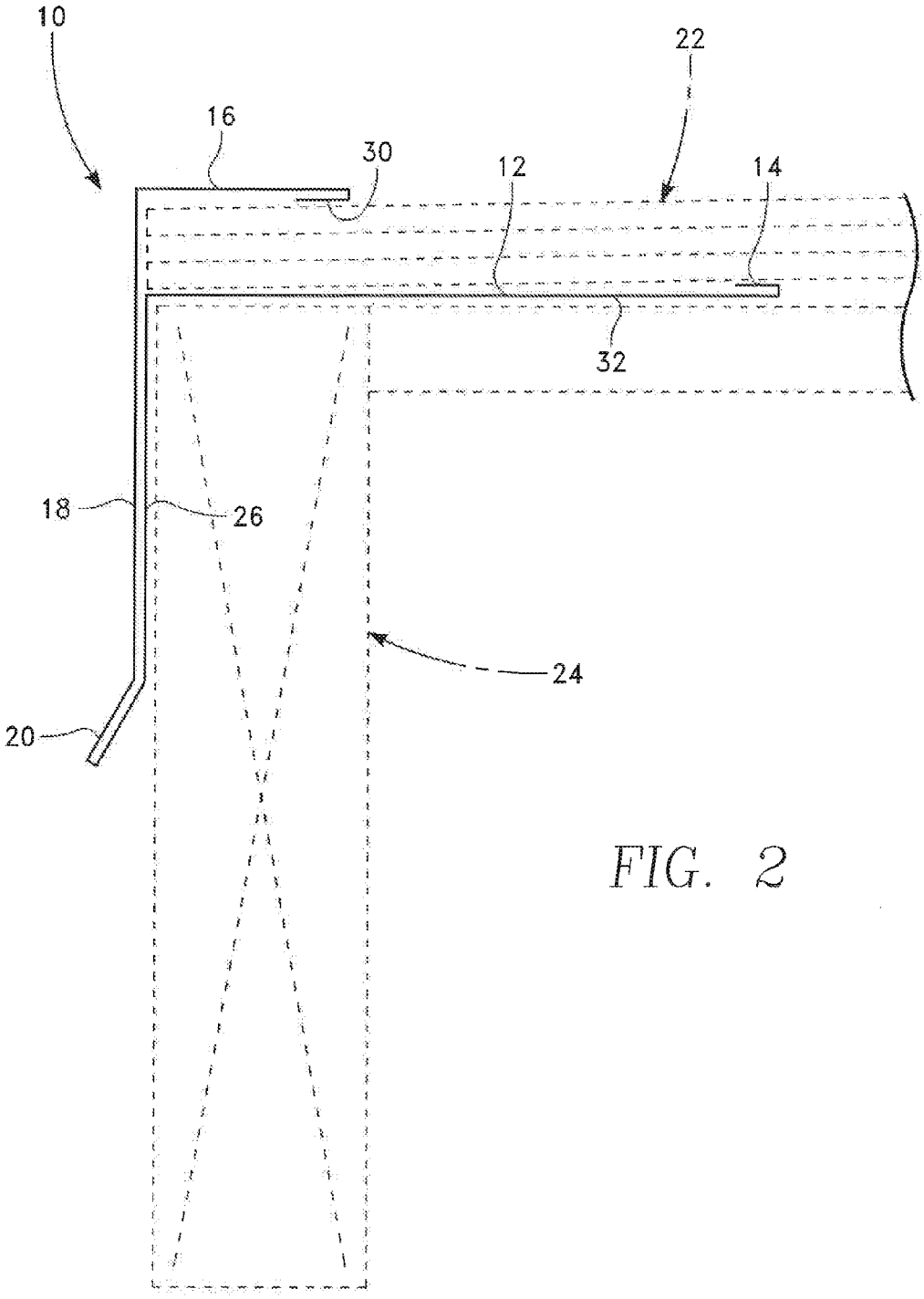
FIG. 2 is a side view of the apparatus of the instant invention as it is applied to a roof.

As seen in FIG. 2, attached to the roof, the apparatus 10 provides for the redirection of water from above the roofing material 22 on the top surface panel 16 down the exposed face 18 along the outer surface 20 of angled panel 28. The fascia 24 remains dry and the roofing material 22 is protected from the elements. For the use of the apparatus along the eaves the option of holes in 36 may be used. In the event water is trapped between the top surface panel 16 and the base 12, holes 36 are included to allow the water to escape.

The illustrations and examples provided herein are for explanatory purposes only and are not intended to limit the scope of the appended claims. This disclosure is to be considered an exemplification of the principles of the invention and is not intended to limit the spirit and scope of the invention and/or claims of the embodiment illustrated. Those skilled in the art will make modifications to the invention for particular applications of the invention.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment, a method embodiment, or even merely a variation of any element of these. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. A continuous one-piece apparatus for the protection of roofing materials from weather elements comprising:

a base that attaches to a roof, said base having a top surface, a bottom surface, a first side with a second side parallel to said first side, a third side that is proximate the edge of said roof and a fourth side that is parallel with said third side and that is distal the edge of said roof;

a first panel that is attached to said third side that extends downward from said base at angle so that said first panel is substantially vertical, said panel being substantially planar and transitioning in a second panel that angles away from said panel;

a third panel that is on the opposite side of said second panel that is exposed and from which water drips;

an exposed fourth panel that extends upward from said third panel and that is substantially parallel with said first panel;

a lip extending upward from said fourth side of said base and extending in a direction toward said third side of said based thereby creating an open space between said base and said lip;

a top panel that extends from said exposed fourth panel in a direction away from said exposed fourth panel wherein said top panel is substantially parallel with said base leaving a space between said top panel and said base for the placement therein of roof material.

2. The continuous one-piece apparatus as defined in claim 1 wherein a hem extending upward from said top panel is added that extends in a direction toward said first and fourth panels thereby creating an open space between said top panel and said hem.

3. The continuous one-piece apparatus as defined in claim 1 wherein one or more apertures are placed on said second panel.

* * * * *